US009408426B2

(12) United States Patent
Middo et al.

(10) Patent No.: US 9,408,426 B2
(45) Date of Patent: Aug. 9, 2016

(54) GARMENTS WITH THREE-DIMENSIONAL DESIGNS

(71) Applicant: RENFRO Corporation, Mount Airy, NC (US)

(72) Inventors: Jann Middo, Redondo Beach, CA (US); Gregory T. Matson, Rolling Hills, CA (US)

(73) Assignee: RENFRO CORPORATION, Mount Airy, NC (US)

( * ) Notice: Subject to any disclaimer, the term of this patent is extended or adjusted under 35 U.S.C. 154(b) by 41 days.

(21) Appl. No.: 14/450,794

(22) Filed: Aug. 4, 2014

(65) Prior Publication Data

US 2015/0033438 A1 Feb. 5, 2015

Related U.S. Application Data

(60) Provisional application No. 61/958,650, filed on Aug. 2, 2013.

(51) Int. Cl.
*A41D 27/08* (2006.01)
*A41B 11/00* (2006.01)

(52) U.S. Cl.
CPC ..... *A41D 27/08* (2013.01); *A41B 11/001* (2013.01)

(58) Field of Classification Search
CPC ..... A41D 27/08; A41D 27/00; A41D 11/00; A41D 19/0051; A41D 31/00; A41B 1/08; A41B 11/00; A41B 11/001; A41B 2400/00; A42B 1/004; A42B 1/248
USPC ..... 2/69, 244, 246; 359/23, 376, 377, 462, 359/464, 466, 477
See application file for complete search history.

(56) References Cited

U.S. PATENT DOCUMENTS

| | | | | |
|---|---|---|---|---|
| 2,171,452 | A | 8/1939 | McAdams | |
| 2,910,849 | A | 11/1959 | Levin | |
| 4,189,049 | A * | 2/1980 | Silver | 206/216 |
| 5,494,445 | A | 2/1996 | Sekiguchi et al. | |
| 5,636,385 | A | 6/1997 | Harrison | |
| 5,695,346 | A | 12/1997 | Sekiguchi et al. | |
| 6,209,141 | B1 | 4/2001 | Adeli | |
| 7,107,621 | B2 | 9/2006 | Meekins | |
| 7,267,452 | B2 | 9/2007 | Esses | |
| 7,674,747 | B1 | 3/2010 | Long | |
| 7,841,107 | B2 | 11/2010 | Braynock et al. | |
| 7,976,178 | B2 | 7/2011 | Esses | |
| 8,719,962 | B1 * | 5/2014 | Huff | 2/69 |
| 2002/0023288 | A1 | 2/2002 | Garneau | |
| 2002/0130055 | A1 * | 9/2002 | Morrison, Jr. | 206/297 |
| 2005/0022288 | A1 | 2/2005 | Habert | |

(Continued)

OTHER PUBLICATIONS http://epidemikcoalition.com/2011/02/01/zoom-kobe-vi-neighborhood-pack-pushes-the-limit-with-graphics-on-sneakers/, Feb. 1, 2011.*

*Primary Examiner* — Andrew W Collins
(74) *Attorney, Agent, or Firm* — Kilpatrick Townsend & Stockton LLP

(57) ABSTRACT

Certain aspects and features of the present disclosure relate to garments, such as socks, that incorporate one or more three-dimensional designs, such as three-dimensional anaglyphs. A design is incorporated into the garment through knitting, sewing, printing, or other suitable methods. The garment can be provided as a kit that includes any suitable eyewear necessary for discerning the design.

12 Claims, 9 Drawing Sheets
(7 of 9 Drawing Sheet(s) Filed in Color)

(56) References Cited

U.S. PATENT DOCUMENTS

2005/0229294 A1* 10/2005 Khulusi ..... 2/431
2008/0190470 A1* 8/2008 Johnston et al. ..... 135/33.2
2009/0034012 A1 2/2009 Northup et al.
2009/0061173 A1* 3/2009 Liao et al. ..... 428/196
2011/0008618 A1* 1/2011 Weedlun ..... 428/343
2011/0063726 A1* 3/2011 Ramstad ..... 359/464
2012/0204307 A1 8/2012 De Mattei et al.
2014/0062017 A1* 3/2014 Alvite et al. ..... 273/153 R

* cited by examiner

GARMENTS WITH THREE-DIMENSIONAL DESIGNS

CROSS REFERENCE TO RELATED APPLICATIONS

The present application claims the benefit of U.S. Provisional Patent Application No. 61/958,650 filed Aug. 2, 2013 entitled "Garments with Three-Dimensional Imaging," which is hereby incorporated by reference in its entirety.

TECHNICAL FIELD

The present disclosure relates to garments generally and more specifically to wearable garments with designs thereon.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The specification makes reference to the following appended figures, in which use of like reference numerals in different figures is intended to illustrate like or analogous components.

DETAILED DESCRIPTION

Figure 1:
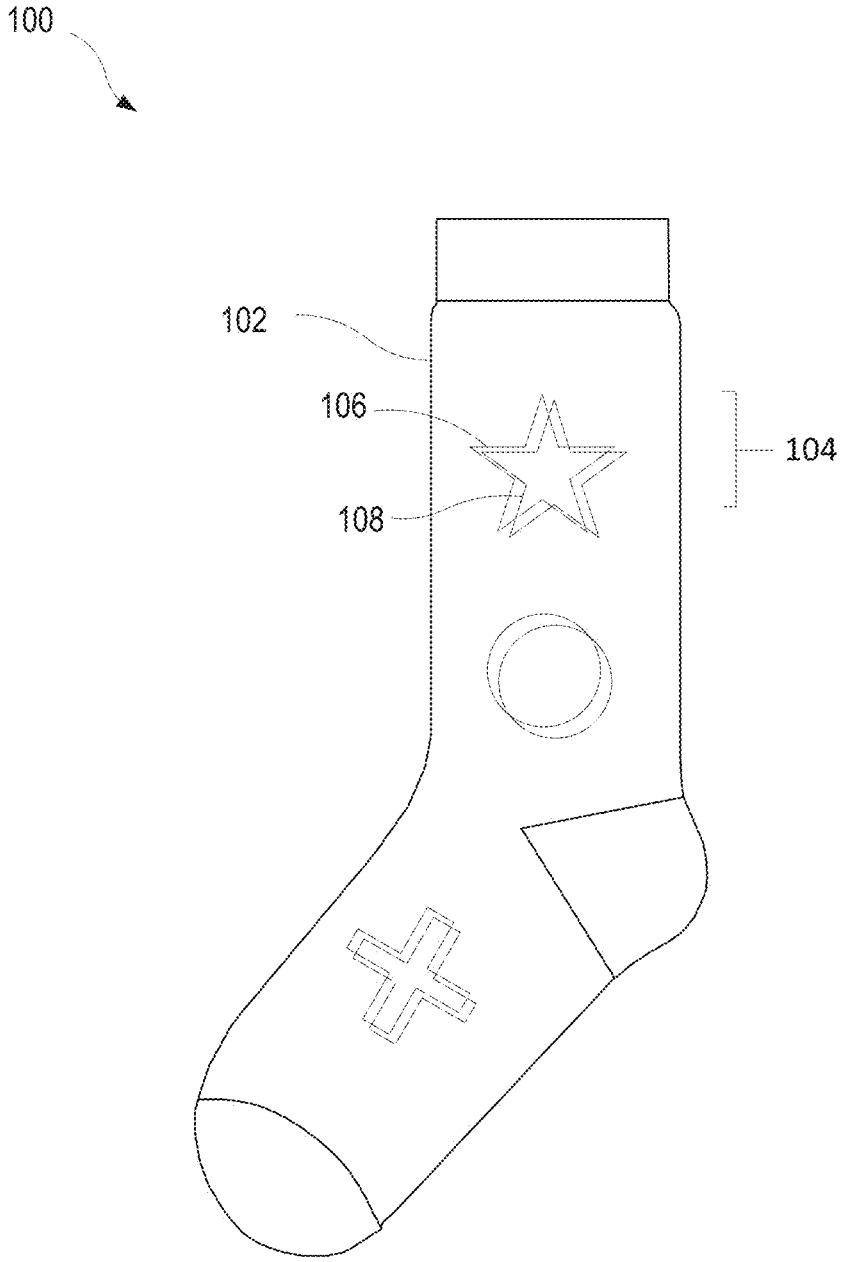
FIG. 1 is a side view of a garment with a three-dimensional design according to one embodiment.

Certain aspects and features of the present disclosure relate to garments, such as socks, that incorporate one or more three-dimensional designs, such as three-dimensional anaglyphs. A design is incorporated into the garment through knitting, sewing, printing, or other suitable methods. The garment can be provided as a kit that includes any suitable eyewear necessary for discerning the design.

While disclosed herein with reference to socks, the present disclosure relates to any suitable garments. Non-limiting examples of some suitable garments include shirts, hats, gloves, ties, and pants. The features disclosed herein can be applied to socks, accessories (e.g., socks, hats, scarves, and gloves), and/or clothing (e.g., socks, shirts, and pants).

The one or more three-dimensional designs can be incorporated into a garment when the garment is initially formed (e.g., through knitting the three-dimensional design into the garment as the garment is knitted). In other embodiments, a three-dimensional design can be applied to the garment after the garment is initially formed (e.g., through printing and/or embroidery).

The one or more three-dimensional designs comprise visual elements that may be incorporated into the garment in various ways. Examples of some suitable ways of incorporating the visual elements into the garment include knitting, sewing and printing. The visual elements can be incorporated into the garment by other methods. A garment with multiple visual elements can include some visual elements incorporated into the garment in a first way (e.g., knitting) and other visual elements incorporated into the garment in a second way (e.g., printing). Any combination of incorporating visual elements into a garment can be used.

In some embodiments, the knitting pattern for the particular garment (e.g., a particular design of the garment) is selected so that the resultant visual elements of the design produces a three-dimensional effect. In some embodiments, suitable glasses or other eyewear may be needed to appreciate the three-dimensional nature of the design. Such glasses or eyewear may be included in a kit along with the garment incorporating the three-dimensional designs. In some embodiments, the suitable eyewear is included in the same packaging as the garment. An example of suitable eyewear is a pair of paper three-dimensional glasses. Suitable eyewear includes filters designed to allow a wearer to discern the three-dimensional nature of the three-dimensional design.

For example, a three-dimensional design that is an anaglyph may incorporate red and cyan visual elements. Eyewear can utilize red and cyan filters to provide different images to the left and right eyes of a viewer, thus causing the design to appear three-dimensional to a viewer using the eyewear. Other color combinations can be used. Generally, color combinations are used with opposing colors, but any color combination can be used.

In some embodiments, the three-dimensional design is configured such that the images provided to the left and right eyes of a viewer using appropriate eyewear represent the images a viewer would see out of the viewer's left and right eyes, respectively, when viewing a three-dimensional object. In other embodiments, the three-dimensional design is configured such that the images provided to the left and right eyes of a viewer do not represent the images a viewer would see out of the viewer's left and right eyes, respectively, when viewing a three-dimensional object, but rather are complementary images that provide a pleasing, three-dimensional-like image.

In some embodiments, the designs are selected so that when viewed without appropriate eyewear, they are still aesthetically pleasing two-dimensional designs.

In some embodiments, the three-dimensional effect is created by the specific combination of colors used. In one embodiment, blue (e.g., cyan blue), red (e.g., red pantone 199C), and yellow (e.g., yellow pantone yellow C), visual elements are used in a design that creates a three-dimensional effect when viewed with a pair of three-dimensional glasses. The garment can be knitted using yarns that are blue (e.g., cyan blue), red (e.g., red pantone 199C), and yellow (e.g., yellow pantone yellow C). Other colors may be used as well.

In some embodiments, a black background is used, although the background may be red, blue, yellow, white, or any other suitable color. In some embodiments, yellow is not used at all and the three-dimensional effect is created based on the pattern of red and blue colors alone.

The garments may be formed on any suitable machine using any suitable yarn, thread, fibers, or other suitable materials. In one embodiment, the garments are 200-needle count socks made of a cotton polyester blended yarn, although other yarns may be used.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a side view of a garment 100 with a three-dimensional design 104 according to one embodiment. The garment 100 includes one or more sections of fabric 102 having at least one three-dimensional design 104 incorporated thereon. The design 104 is incorporated on the fabric 102 using any suitable method or combination of methods, including by knitting or by printing. The design 104 comprises a first visual element 106 and a second visual element 108. Some designs 104 include more than two visual elements.

The first visual element 106 is a first color and the second visual element 108 is a second color that is different than the first color. If desired, the colors for the first visual element 106 and second visual element 108 can be selected such that the left and right filters of appropriate eyewear will filter out light reflected off the first visual element 106 and second visual element 108, respectively, and will allow through light reflected off the second visual element 108 and first visual element 106, respectively.

Figure 2:
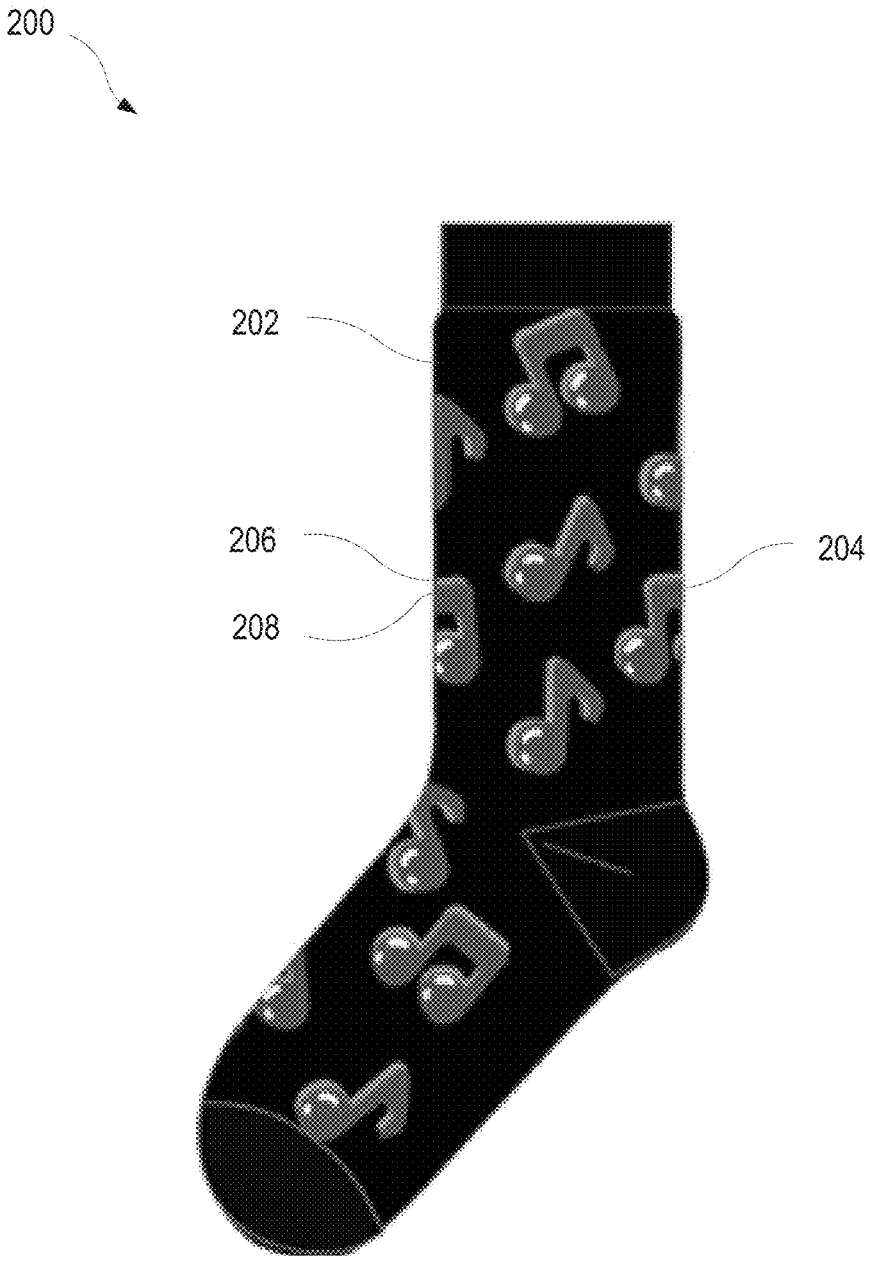
FIG. 2 is a colorized side view of a garment with a three-dimensional design according to one embodiment.

FIG. 2 is a colorized side view of a garment 200 with multiple three-dimensional designs 204 according to one embodiment. In this embodiment, the three-dimensional designs 204 are musical notes. Each three-dimensional design 204 is made of a first visual element 206 and a second visual element 208. The first visual element 206 is cyan and the second visual element 208 is red. Other colors may be used. The three-dimensional designs 204 are incorporated into a section of fabric 202. When viewed through appropriate eyewear, the three-dimensional designs 204 may appear like three-dimensional musical notes.

Figure 3:
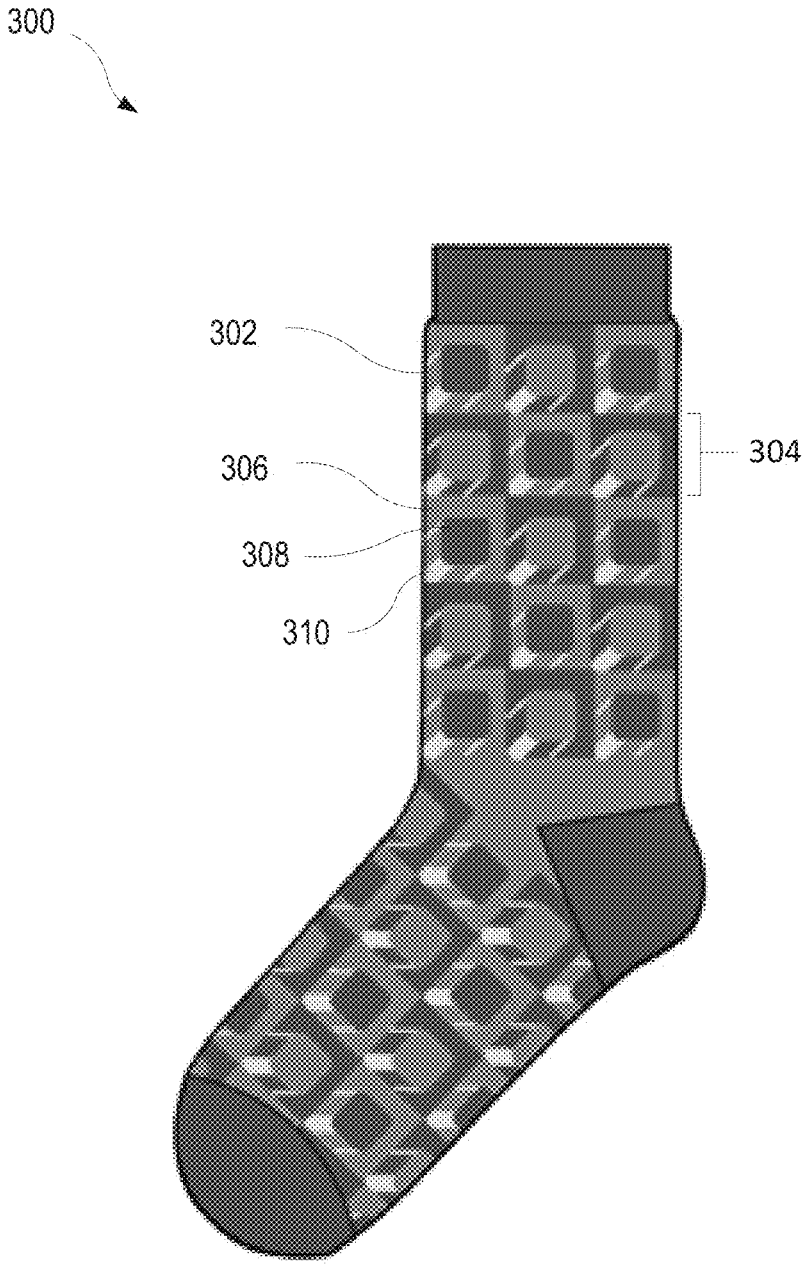
FIG. 3 is a colorized side view of a garment with a three-dimensional design according to one embodiment.

FIG. 3 is a colorized side view of a garment 300 with multiple three-dimensional designs 304 according to one embodiment. The three-dimensional designs 304 are patterns of boxes. Each three-dimensional design 304 is made of a first visual element 306, a second visual element 308, and a third visual element 310. The first visual element 306 is cyan, the second visual element 308 is red, and the third visual element 310 is yellow. Other colors may be used. The three-dimensional designs 304 are incorporated into a section of fabric 302. When viewed through appropriate eyewear, the three-dimensional designs 304 may appear like pleasing, three-dimensional-like patterns.

Figure 4:
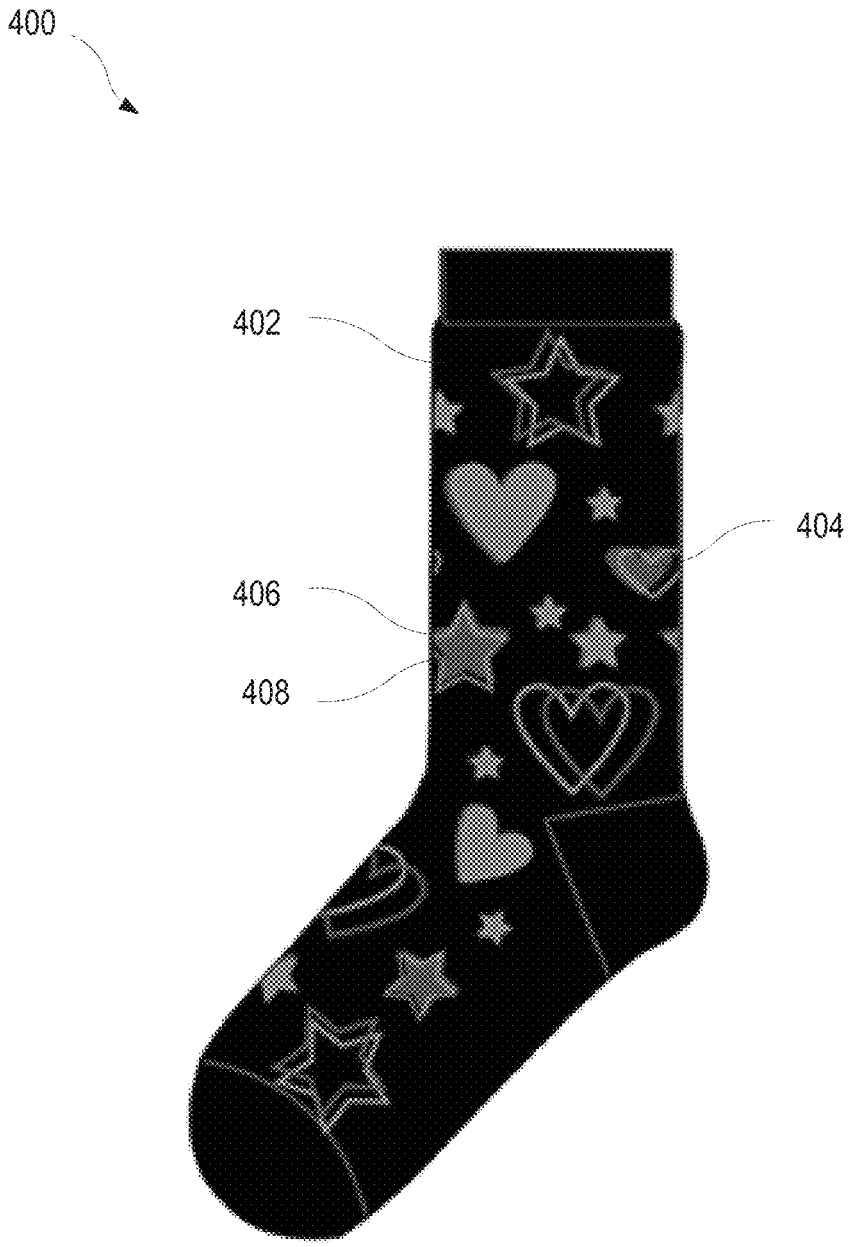
FIG. 4 is a colorized side view of a garment with a three-dimensional design according to one embodiment.

FIG. 4 is a colorized side view of a garment 400 with multiple three-dimensional designs 404 according to one embodiment. The three-dimensional designs 404 are various shapes, including hearts and stars. Each three-dimensional design 404 is made of a first visual element 406 and a second visual element 408. The first visual element 406 is cyan and the second visual element 408 is red. Other colors may be used. The three-dimensional designs 404 are incorporated into a section of fabric 402. When viewed through appropriate eyewear, the three-dimensional designs 404 may appear like three-dimensional shapes, such as hearts and stars.

Figure 5:
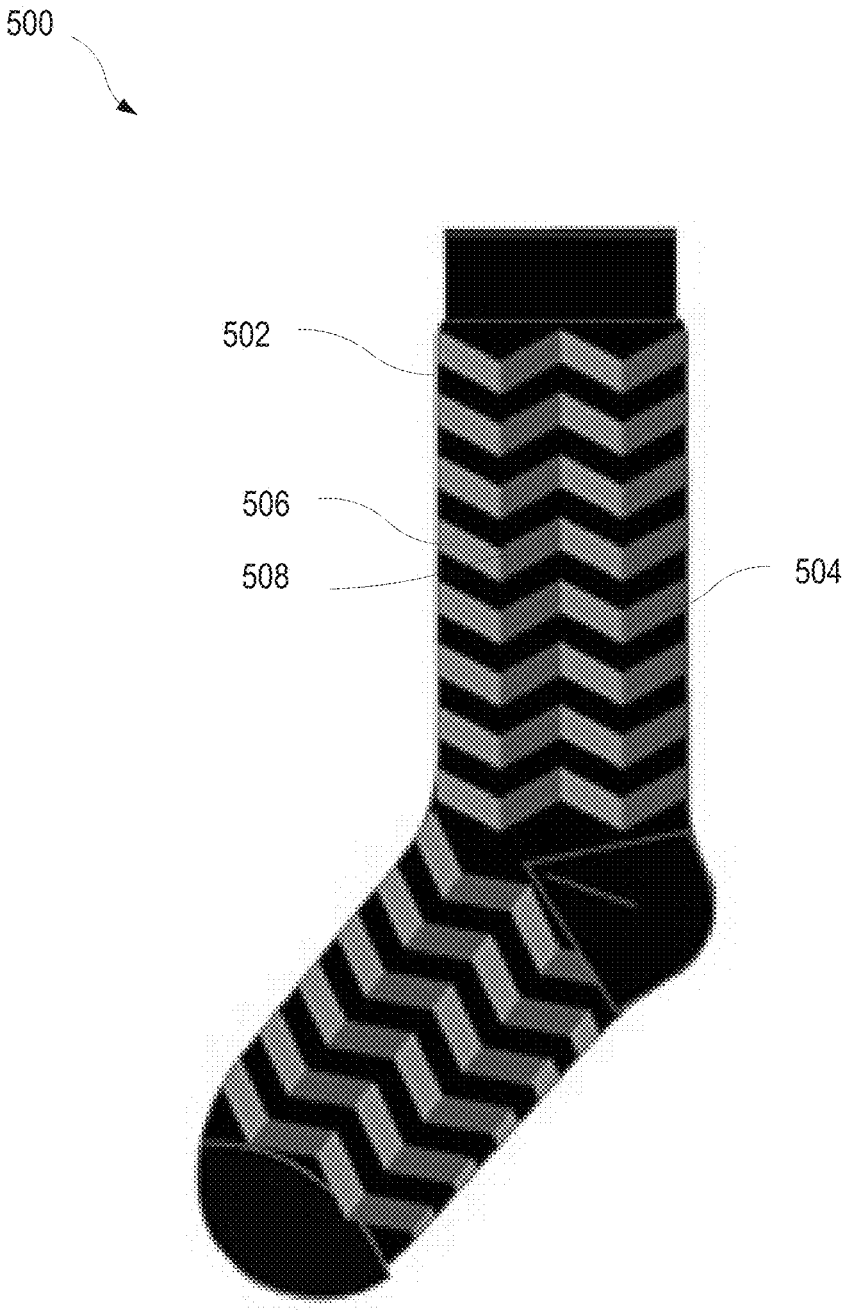
FIG. 5 is a colorized side view of a garment with a three-dimensional design according to one embodiment.

FIG. 5 is a colorized side view of a garment 500 with multiple three-dimensional designs 504 according to one embodiment. The three-dimensional designs 505 are various chevron shapes. Each three-dimensional design 504 is made of a first visual element 506 and a second visual element 508. The first visual element 506 is cyan and the second visual element 508 is red. Other colors may be used. The three-dimensional designs 504 are incorporated into a section of fabric 502. When viewed through appropriate eyewear, the three-dimensional designs 504 may appear as pleasing, three-dimensional-like patterns of chevrons or partial chevrons.

Figure 6:
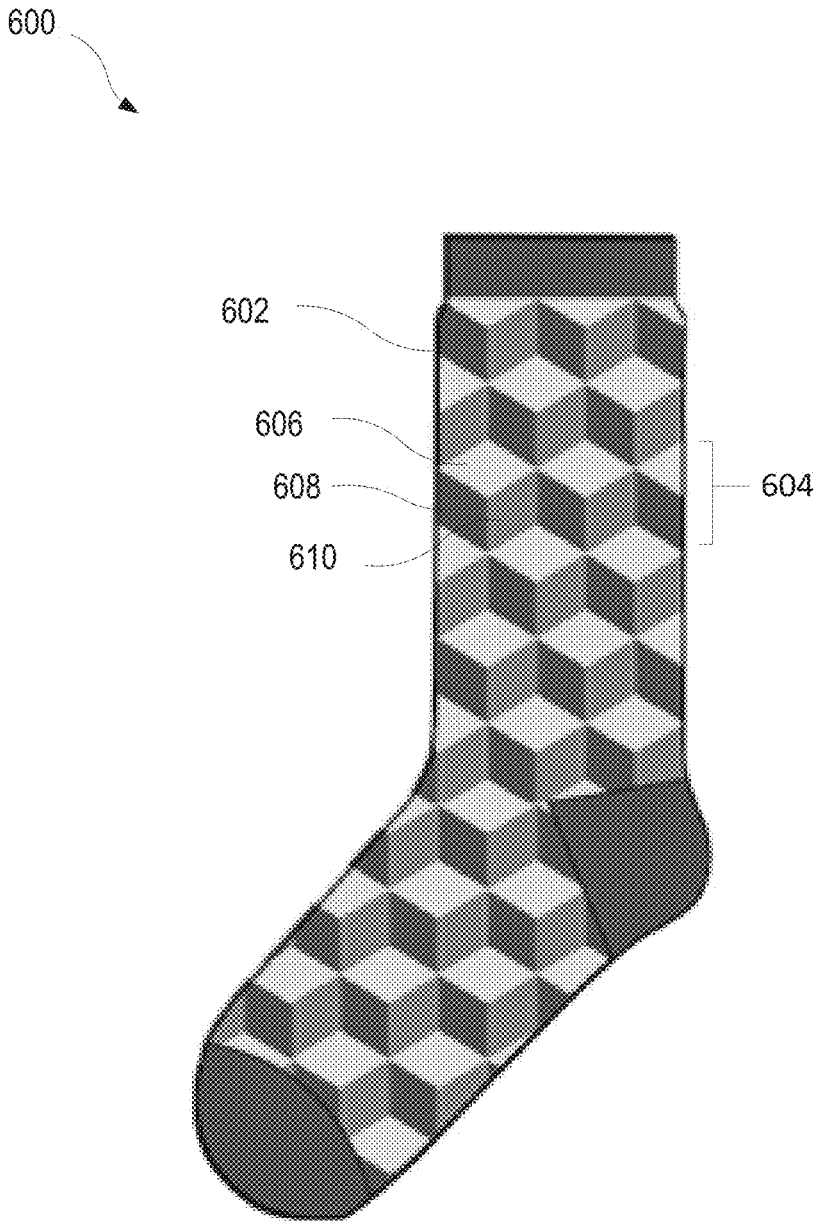
FIG. 6 is a colorized side view of a garment with a three-dimensional design according to one embodiment.

FIG. 6 is a colorized side view of a garment 600 with multiple three-dimensional designs 604 according to one embodiment. The three-dimensional designs 604 are patterns of boxes. Each three-dimensional design 604 is made of a first visual element 606, a second visual element 608, and a third visual element 610. The first visual element 606 is yellow, the second visual element 608 is red, and the third visual element 610 is cyan. Other colors may be used. The three-dimensional designs 604 are incorporated into a section of fabric 602. When viewed through appropriate eyewear, the three-dimensional designs 604 may appear as pleasing, three-dimensional-like patterns.

Figure 7:
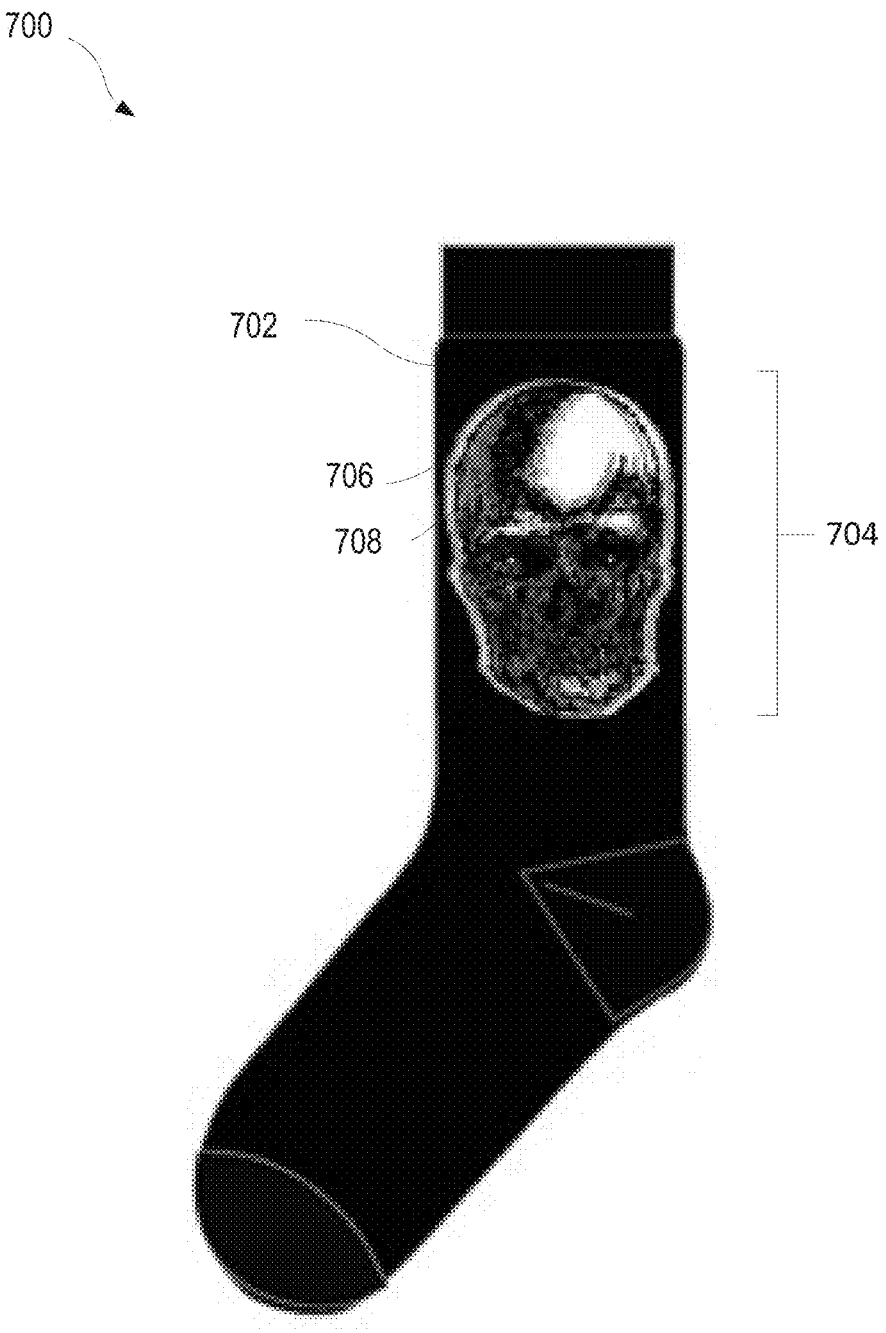
FIG. 7 is a colorized side view of a garment with a three-dimensional design according to one embodiment.

FIG. 7 is a colorized side view of a garment 700 with a three-dimensional design 704 according to one embodiment. The three-dimensional design 704 is a skull. The three-dimensional design 704 is made of a first visual element 706 and a second visual element 708. The first visual element 706 is cyan and the second visual element 708 is red. Other colors may be used. The three-dimensional design 704 is incorporated into a section of fabric 702. When viewed through appropriate eyewear, the three-dimensional design 704 may appear like a three-dimensional skull.

Figure 8:
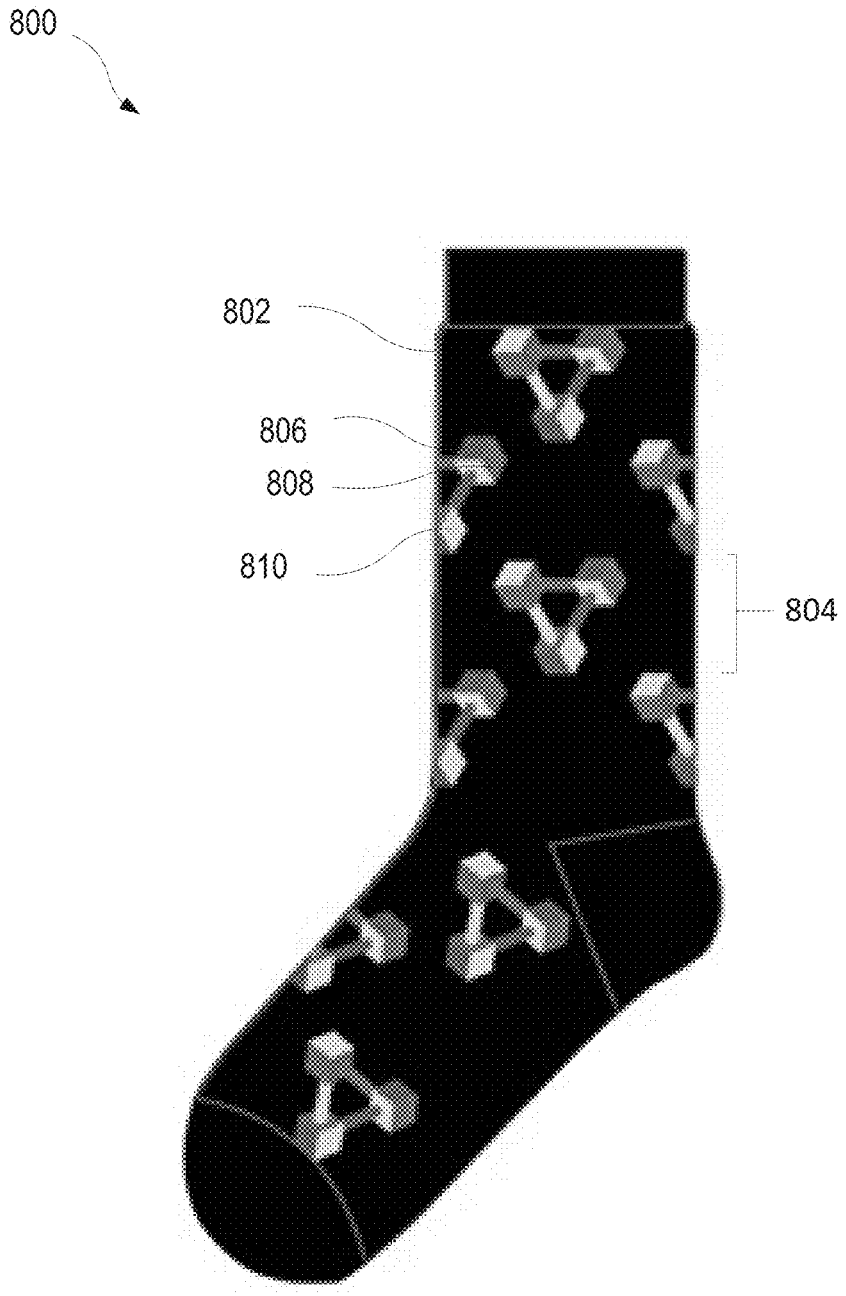
FIG. 8 is a colorized side view of a garment with a three-dimensional design according to one embodiment.

FIG. 8 is a colorized side view of a garment 800 with multiple three-dimensional designs 804 according to one embodiment. The three-dimensional designs 804 are patterns of connected boxes. Each three-dimensional design 804 is made of a first visual element 806, a second visual element 808, and a third visual element 810. The first visual element 806 is yellow, the second visual element 808 is red, and the third visual element 810 is cyan. Other colors may be used. The three-dimensional designs 804 are incorporated into a section of fabric 802. When viewed through appropriate eyewear, the three-dimensional designs 804 may appear as pleasing, three-dimensional-like patterns.

Figure 9:
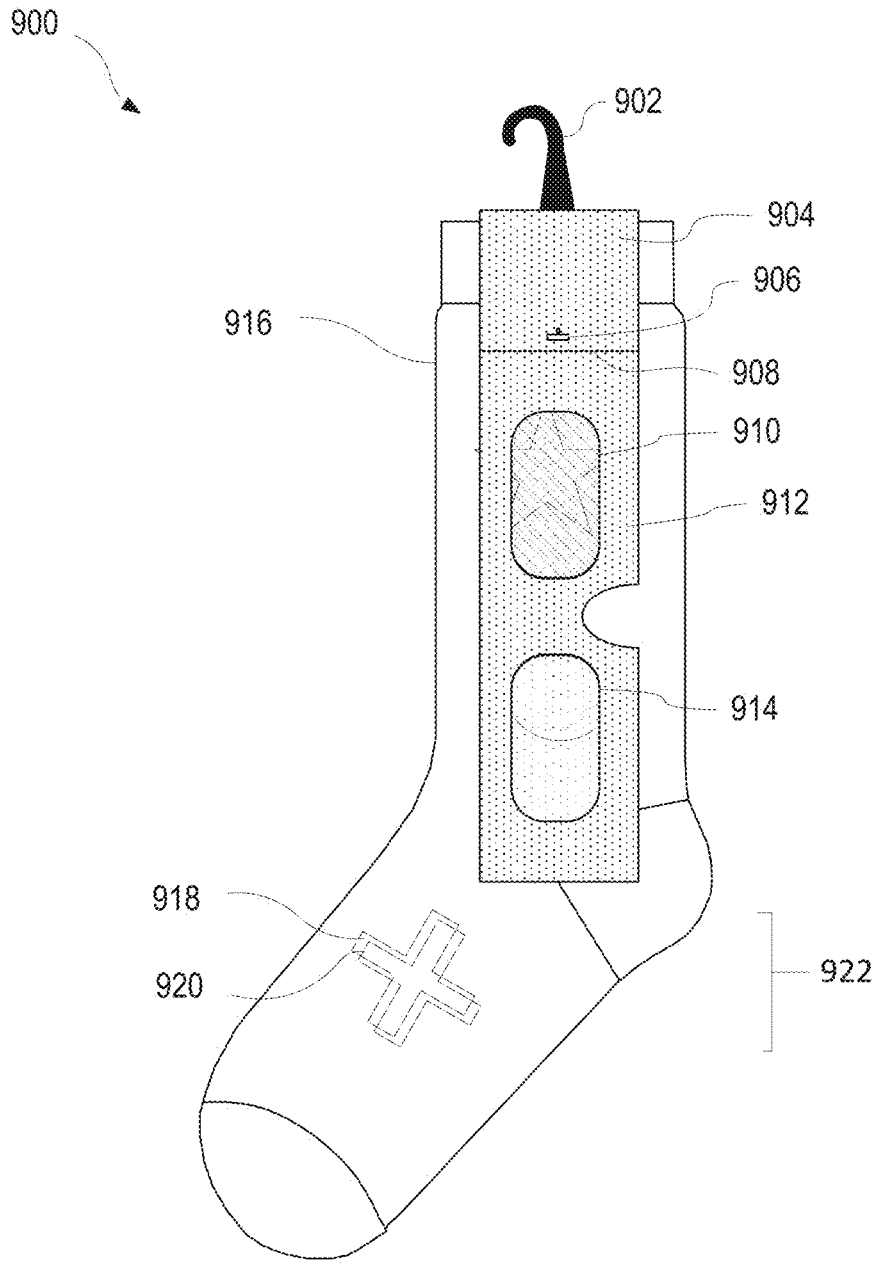
FIG. 9 is a side view of a kit including a garment with a three-dimensional design according to one embodiment.

FIG. 9 is a side view of a kit 900 comprising a garment 916 and three-dimensional-viewing eyewear 912 according to one embodiment. The kit 900 can include a garment 916 having one or more three-dimensional designs 922 as described above. Each three-dimensional design 922 can include a first visual element 918 and a second visual element 920. The kit 900 can further include appropriate eyewear 912 for viewing the three-dimensional designs. The eyewear 912 can be included with packaging, such as a packaging section 904. The eyewear 912 can be formed of the same piece of material as the packaging section 904, wherein an end-user can use a blade or scissors to separate the packaging section 904 from the eyewear 912, although this need not be the case. In some embodiments, a perforation 908 can separate the eyewear 912 and the packaging section 904 to facilitate removal. It may be desirable to have no perforation 908, to discourage shoppers from detaching the eyewear 912 when the garment 916 is on display in a store or retail location.

The packaging section 904 can include a fastener 906 (e.g., a plastic tagging barb) to removably attach the packaging section 904, and thus the eyewear 912, to the garment 916. The packaging section 904 can include a hook 902 that can be used to hang the kit 900 on a display in a store or retail location. In alternate embodiments, instead of or in addition to a hook 902, a hole or other mechanism can be incorporated into the packaging section 904 to enable the kit 900 to be more easily placed on display at a retail location.

The eyewear 912 can include a first filter 910 and a second filter 914. As described above, the first filter 910 can filter out most, all, or substantially all of the light reflected off of the first visual element 918, while allowing to pass through most, all, or substantially all of the light reflected off of the second visual element 920. The second filter 914 can filter out most, all, or substantially all of the light reflected off of the second visual element 920, while allowing to pass through most, all, or substantially all of the light reflected off of the first visual element 918. In some embodiments, the eyewear 912 includes foldable arms (e.g., "temples") designed to fit over a user's ears to facilitate wearing the eyewear 912. In other embodiments, such as that shown in FIG. 9, the eyewear 912 contains no arms.

In other embodiments, the packaging includes a holder, such as a pouch, into which the eyewear may be provided. As used herein, reference to eyewear being removably attached to the garment is inclusive of eyewear that may be freely positioned within a pouch that is removably attached to the garment.

In other embodiments, eyewear may be placed within an opening of the garment and removably sealed therein. For example, eyewear may be placed within a garment that is a sock and packaging may be removably attached to the top of the sock to removably seal the eyewear within the sock. As used herein, reference to eyewear being removably attached to the garment is inclusive of eyewear that is removably sealed within the garment.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A kit, comprising:

a garment having a design incorporated thereon, the design comprising a first visual element and a second visual element;

a packaging section removably fastened to the garment; and eyewear, coupled to the packaging, comprising a first filter configured to filter out light reflected off the first visual element and allow through light reflected off the second visual element.

2. The kit of claim 1, wherein the first visual element and the second visual element are positioned to produce a three-dimensional design when viewed through the eyewear.

3. The kit of claim 1, wherein the garment is a sock.

4. A method, comprising:

incorporating a first visual element into a garment;

incorporating a second visual element into the garment, wherein the first visual element and the second visual element together form a design, and wherein the first visual element is a first color and the second visual element is a second color;

removably attaching a packaging section to the garment, the packaging section including eyewear coupled thereto, the eyewear comprising a first filter operable to filter out light reflected off the first visual element while allowing through light reflected off the second visual element.

5. The method of claim 4, wherein the eyewear is removably coupled to the packaging section at a perforation.

6. The method of claim 4, wherein the packaging section includes a hanger for supporting the packaging section and the removably fastened garment on a display.

7. The method of claim 4, wherein the eyewear is a separate piece of material from the packaging section.

8. The method of claim 4, wherein the garment is a sock.

9. The kit of claim 1, wherein the garment is a glove.

10. The kit of claim 1, wherein the eyewear is removably coupled to the packaging at a perforation.

11. The kit of claim 1, wherein the packaging section includes a hanger for supporting the packaging section and the removably fastened garment on a display.

12. The kit of claim 1, wherein the eyewear is a separate piece of material from the packaging section.

* * * * *